US010076764B2

(12) United States Patent
Lunde et al.

(10) Patent No.: US 10,076,764 B2
(45) **Date of Patent: *Sep. 18, 2018**

(54) APPARATUS FOR PRODUCING RECONFIGURABLE WALLS OF WATER

(71) Applicant: Technifex Products, LLC, Valencia, CA (US)

(72) Inventors: Montgomery C. Lunde, Valencia, CA (US); Clement Folckemer, South Pasadena, CA (US)

(73) Assignee: Technifex Products, LLC, Valencia, CA (US)

( * ) Notice: Subject to any disclaimer, the term of this patent is extended or adjusted under 35 U.S.C. 154(b) by 324 days.

This patent is subject to a terminal disclaimer.

(21) Appl. No.: 15/092,450

(22) Filed: Apr. 6, 2016

(65) Prior Publication Data

US 2016/0263491 A1 Sep. 15, 2016

Related U.S. Application Data

(62) Division of application No. 14/444,898, filed on Jul. 28, 2014, now Pat. No. 9,440,251, which is a division of application No. 12/901,524, filed on Oct. 9, 2010, now Pat. No. 8,807,452.

(51) Int. Cl.

| | |
|---|---|
| ***B05B 17/08*** | (2006.01) |
| ***A63J 11/00*** | (2006.01) |
| ***A63G 31/00*** | (2006.01) |
| ***B05B 1/20*** | (2006.01) |

(52) U.S. Cl.

CPC ..... *B05B 17/085* (2013.01); *A63G 31/007* (2013.01); *A63J 11/00* (2013.01); *B05B 1/20* (2013.01); *B05B 17/08* (2013.01)

(58) Field of Classification Search

CPC ..... B05B 1/20; B05B 17/08; B05B 17/085; A63G 31/007; A63J 11/00

See application file for complete search history.

(56) References Cited

U.S. PATENT DOCUMENTS 4,294,406 A * 10/1981 Pevnick ..... B05B 17/08 222/422
5,005,762 A 4/1991 Cacoub
5,067,653 A 11/1991 Araki et al.
5,265,802 A 11/1993 Hobbs et al.
(Continued)

FOREIGN PATENT DOCUMENTS

EP 0 814 369 B1 12/1997
JP 63-200787 A 8/1988
(Continued)

*Primary Examiner* — Ryan A Reis
(74) *Attorney, Agent, or Firm* — Christopher J. Kulish

(57) ABSTRACT

The present invention is directed to an apparatus for producing a water maze from walls of falling water that can be reconfigured to change the maze. In one embodiment, the apparatus is comprised of a plurality of spray bars that are each capable of producing a separate wall of falling water droplets and a plurality of water valves that are each associated with only one spray bar. The water valves can be used to define at least two different paths between the entrance and exit of the maze. The apparatus is also capable of being used to create interesting visual effects by projecting light/images on to multiple screens created by walls of falling water droplets.

11 Claims, 13 Drawing Sheets

(56) References Cited

U.S. PATENT DOCUMENTS

| | | | | |
|---|---|---|---|---|
| 5,270,752 | A | 12/1993 | Kataoka et al. | |
| 5,368,228 | A | 11/1994 | Adamson et al. | |
| 5,445,322 | A | 8/1995 | Formhals et al. | |
| 5,736,969 | A | 4/1998 | Kuga et al. | |
| 5,862,990 | A | 1/1999 | White | |
| 6,095,889 | A | 8/2000 | Demarinis | |
| 6,095,927 | A | 8/2000 | Malone | |
| 6,176,027 | B1 * | 1/2001 | Blount | B05B 17/085 40/406 |
| 6,557,777 | B1 | 5/2003 | Pevnick | |
| 6,675,538 | B2 | 1/2004 | Candio | |
| 6,731,429 | B2 | 5/2004 | Lunde | |
| 6,855,062 | B1 | 2/2005 | Truong | |
| 7,682,259 | B1 * | 3/2010 | Edwards | A63G 31/007 472/117 |
| 8,807,452 | B2 * | 8/2014 | Lunde | B05B 1/20 239/20 |
| 2013/0119154 | A1 * | 5/2013 | Sawyer | B05B 1/02 239/289 |

FOREIGN PATENT DOCUMENTS

| | | | |
|---|---|---|---|
| JP | 02-302289 | A | 12/1990 |
| JP | 03-251280 | A | 11/1991 |
| JP | 07-289748 | A | 11/1995 |
| JP | 3154439 | B2 | 4/2001 |

* cited by examiner 80
82
90
92A
92B
94
96
120
122
124
126
128
130
132
84
86
88A Fig. 4A
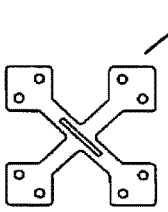
Fig. 4E
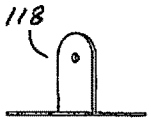
Fig. 4B
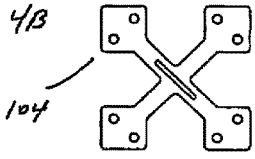
Fig. 4C
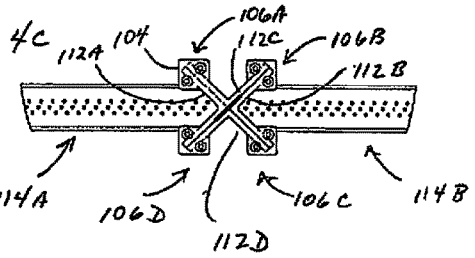
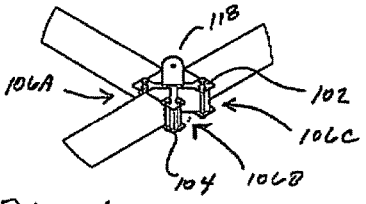
Fig. 4D Fig. 13A
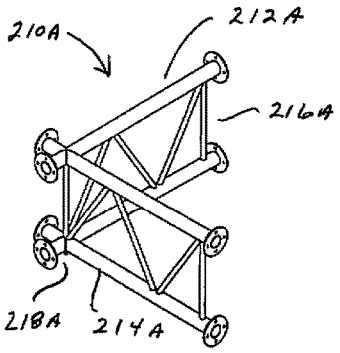
Fig. 13B
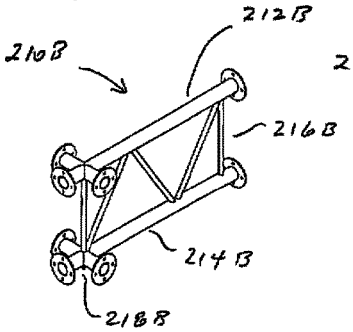
Fig. 13C
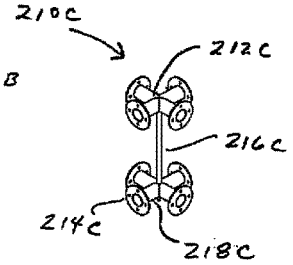
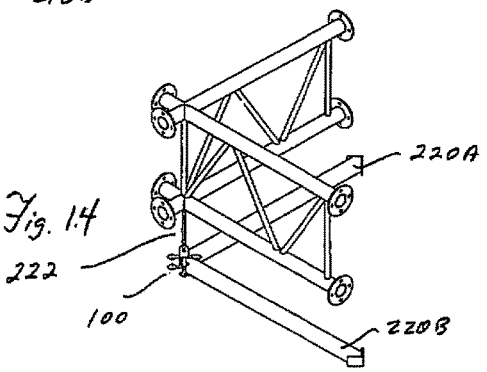
Fig. 14

APPARATUS FOR PRODUCING RECONFIGURABLE WALLS OF WATER

FIELD OF THE INVENTION

The present invention relates to an apparatus for producing a reconfigurable water maze and capable of being adapted to produce visual effects in which light engages one or more walls of water.

BACKGROUND OF THE INVENTION

A maze is a structure that includes an outer wall that encloses an area and typically includes an inner wall structure that is located within the enclosed area. The outer wall and inner wall structure define a path between an entrance and an exit associated with the outer wall. The path being the portion of the maze that is within the outer wall that is not part of the inner wall structure and over which a solver of the maze is allowed to move or navigate. Characteristic of a maze is at least one complex branch, i.e., a point at which two or more passageways of the path intersect and the solver of the maze is confronted with a decision as to which of two or more passageways is to be taken. Further, in most mazes, the entrance and exit are separate. A maze comprised of an outer wall but with no inner wall structure is feasible. However, as such a maze become more complex, it typically becomes more efficient to adopt a maze structure that is comprised of an outer wall and an inner wall structure.

In contrast to a maze, a labyrinth has a single through-route with turns but without any complex branches. A labyrinth is typically comprised of an outer wall and an inner wall structure. However, a labyrinth can also be realized with an outer wall but with no inner wall structure. Additionally, in many labyrinths, the entrance and exit are the same.

Presently, there are three known types of water mazes. The first type is characterized by having a number of nozzles or similar devices that direct water upward in the fashion of a fountain to form the walls of a maze. The second type employs nozzles or similar water ejecting structures that are located in uprights and eject water horizontally to form the walls of a maze. The third type is characterized by the presence of nozzles or other water ejecting structures that direct water downward to form the walls of a maze. In one known water maze of the third type, a lattice work of overhead pipes is provided. Each pipe has holes or a slot that allows water to fall from the pipe to produce a wall or portion of a wall of a maze. A valve is located at each intersection of the pipes in the lattice work and used to control the distribution of water from an upright pipe, which has one end that is also located at the intersection, to each of the pipes associated with the valve. Since there are intersections of two, three, and four pipes in the lattice work of overhead pipes, the valve at each intersection controls the flow from an upright pipe to two, three, or four pipes in the lattice work of pipes. Further, there are two valves associated with each pipe, one at each end of the pipe. Apparently, by appropriate manipulation of the valves, a water maze can be configured and subsequently reconfigured.

SUMMARY OF THE INVENTION

The present invention is directed to an apparatus for producing the third type of water maze in which falling water is used to form the walls of a maze/labyrinth. The term "maze" as used hereinafter refers to a structure that is either a maze or a labyrinth unless the context indicates that either a maze or a labyrinth is being specifically discussed. In one embodiment, the apparatus is comprised of an array of spray bars and an array of water valves with each valve of the array associated with only one spray bar. Each spray bar is capable of being used to produce a wall of falling water droplets over a distance. A wall of falling water droplets is discontinuous in that there are areas of the wall in which there is open space between droplets in a stream of droplets and/or between adjacent streams of water or water droplets. It should be appreciated that the spray bar achieves such a wall by producing several low pressure and substantially continuous streams of water that are each broken into a discontinuous stream of water (i.e., open space between droplets in a stream of droplets) due to the air resistance encountered as the stream of water falls. This is in contrast to devices that produce a continuous wall of falling water and devices that output discrete drops of falling water. Each valve of the array of valves can be placed in either a first state in which water is allowed to flow to the spray bar with which the valve is associated or a second state in which water is prevented from flowing to the associated spray bar. By appropriately setting the state of each of the valves in the array, the array of spray bars can be utilized to define all or part of the walls in a maze. Subsequently, the state of one or more of the valves can be altered to change the wall structure of the maze. Typically, this is done so as to make a significant change to the solution to the maze.

In one embodiment, the arrays of spray bars and water valves are used to define both the outer wall and the inner wall structure of a maze. Since the arrays of spray bars and water valves can be used to define the outer wall, the area occupied by the maze can be altered. Changing which spray bars are used to define the outer wall also changes which spray bars can be used to define the inner wall structure. For example, if the spray bars that are initially used to define the outer wall are the outermost spray bars or outermost spray bar in the array, then all of the other spray bars in the array can be used to define the inner wall structure of the maze. If the spray bar or bars that define the outer wall are subsequently changed such that a lesser area is enclosed by the outer wall, then a smaller group of the array spray bars can be used to define the inner wall structure. Further, in this embodiment, the changes in the path of the maze are achieved by changing the subset of the array spray bars used to define the outer wall and/or changing the subset of the array of the spray bars that are used to define the inner wall structure.

In another embodiment, a portion of the array of spray bars is used to define a static or unchanging outer wall of a maze. The remaining spray bars and the array of water valves are used to define an inner wall structure and to allow the inner wall structure to be altered to change the path of the maze during the time that the outer wall of the maze remains unchanged. In this embodiment, changes in the path of the maze are achieved by changing the subset of the spray bars that are used to define the inner wall structure.

In yet a further embodiment, the outer wall of the maze is not defined by a subset of the array of spray bars and is static or unchanging. For example, the outer wall can be defined by a hedge of shrubs. The arrays of spray bars and water valves are used to define the inner wall structure and to allow the inner wall structure to be altered to change the path of the maze. In this embodiment, changes in the path of the maze are achieved by changing the subset of the spray bars that are used to define the inner wall structure.

It should be appreciated that using spray bars to define an outer wall and/or inner wall structure of a maze does not preclude the use of other structures to define such walls. For example, an array of spray bars and associated water valves can be used to define a portion of an outer wall and masonry or other material used to define another portion of the outer wall. Further, the use of all or a portion of an array of spray bars to define an inner wall structure within an area enclosed by an outer wall does not preclude the use of other structures to define the inner wall structure. For example, masonry can be used to define a portion of the inner wall structure. Further, the inner wall structure can include a closed-loop inner wall of water, other material(s), or combination of water and other material(s) such that the path of the maze is limited to being in the area between the outer wall and the inner closed-loop wall. Similarly, there can be several closed-loop inner walls such that the path of the maze is limited to being in area within the outer wall and outside each of the closed-loop inner walls. Typically, the spray bars are positioned to be substantially level. However, one or more spray bars can be positioned out of level so that when the spray bars is activated the streams of water output be the spray bar commence at one of the spray bar and proceed to the other end of the spray bar, i.e., there is a "wiping" effect. A spray bar can be placed out of level using whatever portion of the hanger system is employed to suspend the spray bar and extends between the spray bar and the overhead support to cause one end of the spray bar to be positioned at a different height than the other end of the spray bar. Alternatively, a "shim" structure can be associated with a spray bar that is to "wipe" when in operation. The shim structure causes one end of the spray bar to be elevated relative to the other end of the spray bar but allows the surfaces that are used to connect the spray bar to other spray bars to be level.

Another embodiment of the invention provides an apparatus for producing the third type of water maze in which falling water is used to define the walls of a maze and facilitating the reconfiguration of the maze while substantially reducing or eliminating the need for upright supports within the "shadow" of the array of spray bars, i.e. the area directly below the array of spray bars. The apparatus includes an array of spray bars and an array of valves that can be used to activate and deactivate spray bars so as to define a maze and subsequently reconfigure the maze. Further, the apparatus includes a hanger system for suspending at least the array of spray bars from an overhead support. While some kind of vertical support structure is associated with the overhead support, this vertical support structure can typically be located adjacent to the periphery of the maze or spaced from the periphery of the maze, thereby reducing or at least substantially eliminating in many instances the need for an array of upright supports within the shadow of the array of spray bars to hold up the array of spray bars. By suspending the array of spray bars from an overhead support, it is feasible to locate the array of water valves and one or more water manifolds that supply water to the valves a substantial distance away from the array of spray bars. With such an arrangement, water lines can be run from the valves to the spray bars with the water lines coming in from the side of the array of spray bars, thereby reducing or eliminating the need for vertical supports located in the "shadow" of the array of spray bars to carry or support water supply lines for the spray bars.

In one embodiment, the ability to suspend the array of spray bars from an overhead support and avoid the use of upright supports for the array of spray bars is enhanced by the use of a spray bar that is lightweight and retains a relatively small amount of water during operation. As such, the cumulative weight of the spray bar and of the water resident in the spray bar during operation is relatively low, thereby reducing the load per unit area on the overhead structure relative to heavier spray bars and/or spray bars that retain relatively large amounts of water during operation.

In another embodiment, the hanger system includes a number of spray bar connectors that serve both to connect spray bars to one another and to provide a surface for engaging an overhead connector that extends between the spray bar connector and an overhead support. In one embodiment, the spray bar connector includes a pair of surfaces that are at an angle to one another and associated with the ends of each of the spray bars that are to be connected to one another. A bracket system engages the angled surfaces associated with the spray bars such that each of the angled surfaces of one spray bar are either co-linear or parallel to at least one of the angled surface associated with another spray bar. In one embodiment, the pair of surfaces associated with the end of each of four spray bars that are to be connected to one another form a right angle and the bracket system engages the pair of surfaces associated with each of the spray bars such that a mitered-style joint is established between the spray bars. The bracket system further includes a surface that is used to engage an overhead connector. The surface can take any one of a number of forms. For instance, the surface can define a hook or hole for engaging a hook extending downward from the overhead support. Another possibility is that the surface defines a more complex surface for engaging an overhead connector that allows for adjustment of the distance between the spray bar connector and the overhead support.

In certain situations, it may be desirable to locate a water valve immediately adjacent to the spray bar with which the valve is associated. For example, locating the valve in this manner may reduce the amount of water that is expelled from a spray bar when the valve is switched from providing water to the spray bar to not providing water to the spray bar relative to another location for the valve. It may also be desirable in certain situations to associate a sub-water manifold (i.e., a portion of an overall water manifold that supplies water to the entire array of spray bars) with a subset of the array of spray bars to simplify the piping connections that need to be made between the source of water and the subset of the array of spray bars. As such, in other embodiments, the hanger system supports the array of spray bars, the array of water valves, and potentially one or more sub-water manifolds.

Another embodiment of the invention provides an apparatus for producing the third type of water maze in which falling water is used to define the walls of a maze and facilitating the relatively quick reconfiguration of the maze. The apparatus includes an array of spray bars and an array of valves that can be used to activate and deactivate spray bars so as to define a maze and subsequently reconfigure the maze. In one embodiment, each of the spray bars in the array of spray bars retains relatively little flowing water when in operation. Consequently, when the flow of water to the spray bar is terminated, the flow of water droplets out of the spray bar terminates relatively quickly. The spray bar includes a tubular member with an inlet for receiving a stream of water and multiple outlets along the length of the tubular member. An outer member at least partially surrounds the tubular member. The outer member has an inner surface that receives the streams of water output by the tubular member and spreads the streams of water along the longitudinal extent of the inner surface such that there is a relatively thin film of water cascading down the inner surface and towards a series of drain holes associated with the outer member. In operation, the longitudinal axes of the tubular member and outer member are substantially horizontally disposed. When the flow of water to the spray bar is terminated, the flow of water from the multiple outlets along the length of the tubular member terminates relatively quickly and the relatively thin film of water flowing down the inner surface of the outer member drains relatively quickly. In one embodiment, a relatively small diameter tubular member is utilized so that when the flow of water is terminated, the expelling of water from the multiple outlets of the tubular member ceases relatively quickly due to the low capacitance of the tubular member per unit length of the member. In another embodiment, a relatively large diameter tubular member is utilized but the multiple outlets are located above the mid-line of the member and preferably close to the top of the tubular member when the member is horizontally disposed. In this case, when the flow of water is terminated, the expelling of water from the multiple outlets ceases relatively quickly due to the locations of multiple outlets.

Another embodiment of the invention provides a kit for producing the third type of water maze in which falling water is used to define the walls of a maze and facilitating the reconfiguration of the maze. The kit includes a plurality of substantially identical spray bars, a plurality of substantially identical spray bar connecting devices for connecting a sub-group of the plurality spray bars to one another, and a plurality of substantially identical valves for use in controlling the flow of water to the plurality of spray bars. In one embodiment, each of the spray bars has two ends that each exhibit a "corner" of two planar surfaces that are at an angle to one another. Each of the connecting devices includes a bracket system that is capable of engaging a predetermined number of spray bars to connect the spray bars to one another. In one embodiment, each of the corners has an interior angle of 90° and an exterior angle of 270°. The bracket system is capable of engaging up to four corners of four different spray bars such that a miter-type joint is established between the joined spray bars. If four spray bars are joined to one another with one of the connectors, the resulting structure has the appearance of a Greek cross. In this case, the plurality of substantially identical spray bar connectors is capable of creating one or more arrays of spray bars that have each have a rectilinear characteristic. Further, these arrays of spray bars can be joined to one another using the spray bar connecting devices so as to form a larger array of spray bars that has a grid characteristic, i.e., the spray bars form squares. Spray bars with corners that have different angles and spray bar connecting devices for connecting different numbers of spray bars to one another are feasible. For instance, in another embodiment, each of the corners of the spray bars has an interior angle of 120° and an exterior angle of 240° and the bracket system of one of the connecting devices is capable of engaging up to three spray bars. If the bracket system is used to engage three spray bars, the resulting structure is similar to the rayed portion of the Mercedes Benz emblem. Further, these arrays of spray bars can be joined to one another using the spray bar connecting devices so as to form a large array of spray bars that has a triangular characteristic, i.e., the spray bars form equilateral triangles. It should be appreciated that by appropriate choice of the corner angles and design of the bracket system arrays of spray bars can be constructed that form other regular polygons. In one embodiment, each of the spray bar connecting devices also includes a surface for use in suspending the connecting device from an overhead support. In yet another embodiment, each of the valves has only one outlet port and, as such, is capable of being associated with only one spray bar.

Another embodiment of the kit includes a plurality of substantially identical spray bars, a plurality of substantially identical spray bar connecting devices that are each capable of connecting a sub-group of the plurality spray bars to one another, and a plurality of substantially identical valves for use in controlling the flow of water to the plurality of spray bars. However, in this embodiment, the kit includes a plurality of modules that each includes a combination of one or more spray bars, one or more spray bar connecting devices, and one or more valves. In one embodiment, a module is comprised of a plurality of spray bars and a plurality of spray bar connecting devices that join the plurality of spray bars to one another. For example, if the corners of the spray bars are 90°/270° type and the bracket system of a spray bar connector is capable of engaging up to four spray bars, one module may be comprised of a sufficient number of spray bars and sufficient number of spray bar connectors to form a 2×2 grid array of spray bars. The use of such a module can significantly reduce the on-site assembly time of a maze apparatus. In another embodiment, a module is comprised of a spray bar and one or more valves that each engages the spray bar.

Another embodiment of the invention provides an apparatus that is capable of: (a) producing the third type of water maze in which falling water is used to define the walls of a maze and facilitating reconfiguration of the maze and (b) providing the ability to project light and/or images on one or more walls of falling water produced by the apparatus to produce a "light" show. Typically, such a light show is produced when the apparatus is not being used to produce a water maze that individuals are going to be attempting to negotiate and in lighting conditions in which a viewer is able to readily discern the light or images being projected on the walls of falling water droplets being produced by the apparatus. The apparatus includes an array of spray bars, an array of valves, and a projection system. The array of valves can be used to activate and deactivate spray bars to define a maze, reconfigure a maze, produce one or more water screens for receiving light, and change the screen or screens for receiving light. It should be appreciated that in this particular application the array of spray bars and array of valves does not necessarily need to be used to create a maze. The projection system can take any number of forms. For example, the projection system can include one or more of colored lights, theatrical lights with gobos, lasers, still projectors for producing still images, video projectors for producing moving images, and other light projecting devices known in the art. When the apparatus is being used to produce a light show, the wall of falling water droplets produced by each activated spray bar forms all or part of a translucent projection screen. The valves can be used to activate spray bars so as to produce at least two such projection screens with one of the screens interposed between the second screen and the projection system. Due to the translucent nature of the screens, the projected light appears on both of the screens. Typically, if the projected light is an image, the image produced on the interposed screen is smaller than the image produced on the distal screen. Further, the valves can be used to activate spray bars so as to change the number and location of the screen or screens that receive a projected image. For example, the valves can be used to "turn on" a first screen that is relatively close to a projector and receives a particular image. Subsequently, the valves can be used to "turn off" the first screen and "turn on" a second screen that is located further from the projector of the particular image. As a consequence, a viewer perceives the particular image to be "chasing" or "moving" about within the space occupied by the screens. The "turning on" and "turning off" of different screens can also be coordinated with the projection of different images. For example, the valves are used to "turn on" a first screen onto which a first image is projected. Subsequently, the valves are used to "turn off" the first screen and to "turn on" a second screen onto which a second, different image is projected. In one embodiment, the projection system includes multiple projectors that each project one or more images and whose projection of images is coordinated with the "turning on" and "turning off" of one or more screens.

BRIEF DESCRIPTION OF THE DRAWINGS

FIGS. 4A-4E illustrates a spray bar connector that is used to connect at least two and as many as four spray bars to one another and to provide a surface for engaging an overhead connector that is used to suspend the spray bar connector from an overhead structure;

FIGS. 13A-13C illustrate components that can be utilized to realize an overhead support, distribute water to the spray bars in an array, and distribute air to the valves;

FIG. 14 illustrates a pair of connected spray bars suspended from one of the components used to realize an overhead support.

DETAILED DESCRIPTION

Figure 1A:
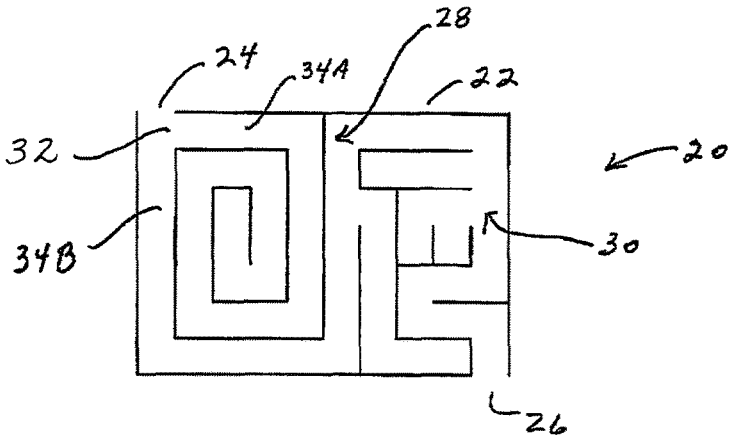
FIGS. 1A and 1B respectively are plan views of a maze and a labyrinth.

A maze is a structure comprised of an outer wall that encloses an area and, in many cases, an inner wall structure that is located within the enclosed area. The outer wall and the inner wall structure define a path between an entrance and an exit that are each associated with the outer wall. The path is the area within the outer wall that is not part of any inner wall structure and over which a player is allowed to move or navigate. Characteristic of a maze is at least one complex branch, i.e., a point at which two or more passageways of the path intersect and the solver of the maze is confronted with a decision as to which of two or more passageways is to be taken. FIG. 1A is an example of a maze 20. The maze 20 includes an outer wall 22 that encloses an area. Associated with the outer wall are an entrance 24 at which a player enters the maze and an exit 26 at which a player that has successfully negotiated the maze exits the maze. While the entrance 24 and the exit 26 are defined by separate gaps in the outer wall 22, it is possible for the entrance and the exit of a maze to be defined by the same gap in an outer wall. The maze 20 includes an inner wall structure 28 that is located within the area enclosed by the outer wall 22. The inner wall structure 28 is comprised of several subsidiary walls, some of which engage the outer wall 22. However, an inner wall structure that is one wall is also feasible. The outer wall 22 and inner wall structure 28 define a path 30. In the maze 20, the path 30 is the white area within the outer wall 22. The maze 20 includes at least one complex branch, a location on the path 30 where two or more passageways intersect and at which a player that is navigating the maze is confronted with a decision as to which of the two passageways to take. Location 32 within the maze 20 is a complex branch location. Location 32 is at the intersection of passageways 34A, 34B and is a location at which a player must make a decision as to whether to follow passage 34A, passageway 34B, or exit the maze 20 via the entrance 24. While the maze 20 has been described as including the outer wall 22 and the inner wall structure 28, a maze having an outer wall and no inner wall structure is feasible. In such a maze, the outer wall alone defines the path.

Figure 1B:
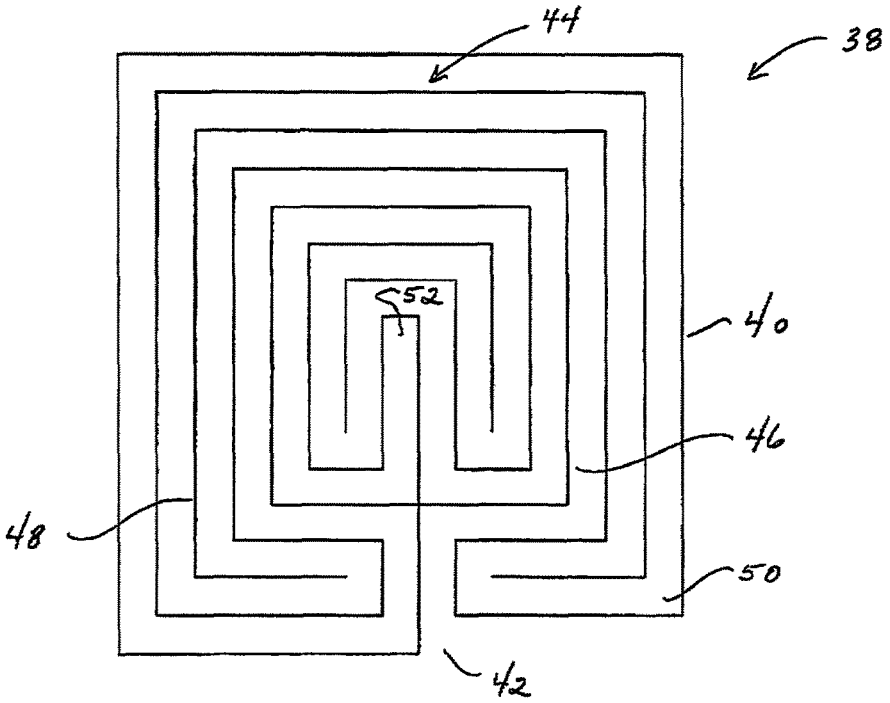

A labyrinth is a structure comprised of an outer wall that encloses an area and, in many cases, an inner wall structure that is located within the enclosed area. Like a maze, the outer wall and inner wall define a path between an entrance and an exit that are each associated with the outer wall. The path is the area within the outer wall that is not part of the inner wall structure and over which a player is allowed to navigate. A labyrinth, unlike a maze, does not have any complex branches. Consequently, the player only needs to follow the path. In many cases, the path terminates at a dead end that precludes further progress by the player. In such a labyrinth, after the player reaches the dead end, the player reverses direction to retrace their steps and exit at the same location at which the player entered the labyrinth. As such, the entrance and the exit of the labyrinth are defined by the same gap in the outer wall. It is, however, possible to have a labyrinth with an entrance and an exit that are separate from one another and defined by separate gaps in the outer wall. FIG. 1B is an example of a labyrinth 38. The labyrinth 38 includes an outer wall 40 that encloses an area. Associated with the outer wall is an entrance/exit 42 which is the location at which a player both enters and exits the labyrinth 38. The labyrinth 38 includes an inner wall structure 44 that is located within the area enclosed by the outer wall 40. The inner wall structure 44 is comprised of a first inner wall 46 that has four branches of varying length and a second inner wall 48. However, an inner wall structure that has only one wall or has more than two walls is feasible. The outer wall 40 and inner wall structure 44 define a path 50. In the labyrinth 38, the path 50 is the white area within the outer wall 40. The labyrinth 38 has a dead end 52 that, once reached by a player, requires the player to reverse direction and retrace their steps to exit the labyrinth 38 at the entrance/exit 42. While the labyrinth 38 has been described as including the outer wall 40 and the inner wall structure 44, a labyrinth having an outer wall and no inner wall structure is feasible. In such a labyrinth, the outer wall alone defines the path.

As used hereinafter to describe one or more embodiments of the invention, the term "maze" refers to a maze that has one or more complex branches or a labyrinth that does not having any complex branches.

Figure 2:
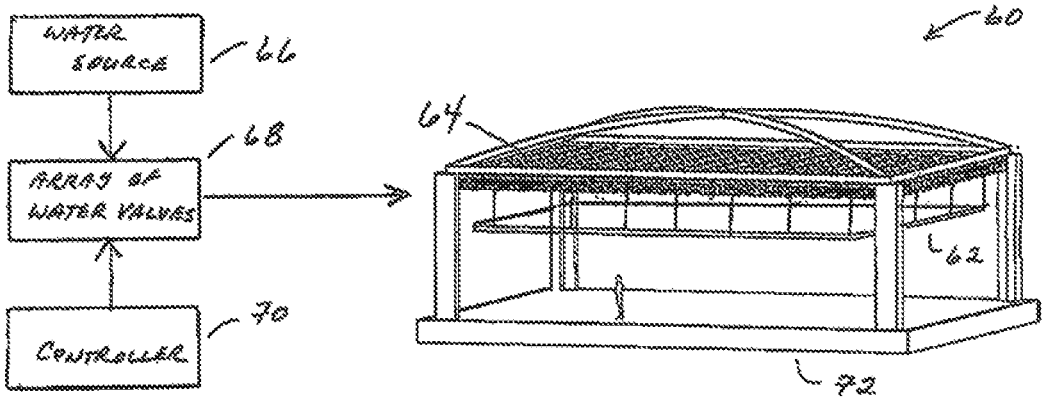
FIG. 2 is a block diagram of an embodiment of an apparatus for producing a reconfigurable water maze.

With reference to FIG. 2, one embodiment of an apparatus for producing a water maze in which falling water is used to form the walls of a maze and allowing reconfiguration of the maze, hereinafter referred to as apparatus 60, is described. Generally, the apparatus 60 includes: (a) an array of spray bars 62, (b) an overhead support 64 from which the array of spray bars 62 is suspended; (c) a water source 66, (d) an array of valves 68 that is used to control the application of water provided by the water source 66 to the array of spray bars 62, (e) a controller 70 that controls the array of valves 68 so that water is provided to certain spray bars of the array of spray bars 62 so as to define the walls of a maze, and (f) a drained floor 72.

The array of spray bars 62 is comprised of a number of spray bars that are located relative to one another so that a subset of the array of spray bars can be used to define an outer wall of a maze and another subset of the array of spray bars can be used to define an inner wall structure of a maze. In the illustrated embodiment, the spray bars are situated relative to one another so as to form a grid pattern comprised of squares. Each spray bar in the array of spray bars 62 is of substantially the same length, a length that is equal to the smallest square presented by the grid pattern of adjoining squares. While it is feasible to use spray bars in an array of spray bars that are of different lengths, it is believed that the use of spray bars of different lengths is likely to make the manufacturing of the spray bars more complicated, the assembly of the apparatus more difficult, and potentially lead to the production of a water mazes or mazes of varying consistency.

With reference to FIGS. 3A-3E, an embodiment of a spray bar 80 is described. The spray bar 80 is comprised of an outer tubular member 82 and an inner tubular member 84. The inner tubular member 84 is located within the outer tubular member 82, has an inlet 86 adapted to receive water from an associated valve when the valve is open, and two series of outlet holes 88A, 88B that each extend along the length of the member 84 and through which water is ejected. The outer tubular member 82 includes a tubular body 90 with corner-mitered open ends that are closed by a pair of corner end caps 92A, 92B. The tubular body 90 has an inner surface 94 for receiving water ejected from the two series of outlet holes 88A, 88B of the inner tubular member 84. The tubular body 90 also has a series of outlet holes 96 through which water passes to form a wall of falling water droplets that, in turn, form a wall or a portion of a wall of a maze.

In the illustrated embodiment, the outer tubular member 82 is approximately 40" in length. In many instances, when a spray bar is not ejecting water to form a wall or portion of a wall of a maze, the spray bar is associated with a passageway of the path of the maze and potentially defines the width of such a passageway. The length of 40" is believed to be an appropriate width for a passageway. However, spray bars of having a greater or lesser length are feasible and may be more appropriate in a particular situation.

The inner tubular member 84 is made from PVC pipe that is capped at both ends. The tubular body 90 is made from PVC and the ends caps 92A, 92B are made from PVC. The end caps 92A, 92B are connected to the tubular body 90 by glue. The mass of the spray bar 80 is approximately 33 ounces/930 grams. It should be appreciated that other light weight materials known to those in the art can be used to realize the inner tubular member 84, tubular body 90, and end caps 92A, 92B. The relatively low mass contributes to the ability to suspend the spray bar 80 and the array of spray bars 62 from an overhead support and reduce the need for upright supports to support the array. In certain cases, any upright supports associated with the overhead support may only be about the periphery of the overhead support. In other cases, upright supports may be needed within the "shadow" of the array of spray bar 62 but spaced further from one another than would otherwise be the case. Moreover, the relatively low cumulative mass of the array of spray bars 62 contributes to being able to suspend the array from an overhead support that covers a substantial area, i.e., an overhead support that spans relatively long distances between points at which upright support is needed. While the use of other lightweight materials for one or more of the inner tubular member 84, tubular body 90, and end caps 92A, 92B, the noted materials are currently preferred due to their relatively low cost and ease with which they can be incorporated into the design of the spray bar 80.

The tubular body 90 is made from a material with a rectangular cross-section to, at least in part, facilitate the machining of the material to create the mitered ends to which the end caps 92A, 92B are attached. The use of a material with a non-rectangular cross-section (e.g., a circular cross-section) is feasible. However, the use of such a material is likely to make the machining of the mitered ends more difficult. Further, it should be appreciated that a material with a U-shaped or open-sided cross-section can be used in place of a tubular structure, provided the U-shaped or open-sided structure is capable of sufficiently containing the water output by the inner tubular member 84.

The dimensions of the inner tubular member 84 and the space and size of the series of outlet holes 88A, 88B associated with the inner tubular member 84 are chosen so that, for the anticipated rate of flow of water into the inlet 86, the flow of water out of each of the series of outlet holes 88A, 88B is roughly equal, thereby substantially evenly distributing the water along the inner surface 94 of the tubular body 90. In the illustrated embodiment, the inner tubular member is 1" in diameter and approximately 40" long. Adjacent holes in each of the group of outlet holes are 0.75" apart and each hole is about 0.25" in diameter.

The series of outlet holes 96 are designed to cumulatively discharge at least as much water per unit time as the inner tubular member 84 is discharging through the series of outlet holes 88A, 88B for the anticipated flow of water into the inlet 86 of the inner tubular member 84. As such, the interior of the outer tubular member 82 accumulates little, if any, water when the spray bar is active. The inner tubular member 84 has a relatively low volume and, as such, contains relatively little water even when the spray bar is in operation. The cumulative mass of the spray bar 80 and the water within the spray bar during operation (i.e., the mass of water in the inner tubular member and flowing down the inner surface 94 of the tubular body 90) is relatively low. For the illustrated embodiment, this cumulative mass is estimated to be about 70 ounces/1984 grams. This, too, contributes to the ability to suspend the array of spray bars 62 from an overhead support that covers a substantial area.

The inner tubular member 84 is designed so that, once the flow of water to the member is terminated, the flow of water from the series of outlet holes 88A, 88B terminates shortly thereafter. This is achieved by appropriately choosing the dimensions of the member 84 and the location of the outlet holes 88A, 88B. In the illustrated embodiment, the member 84 has a relatively small diameter of 1" and the outlet holes 88A, 88B are located along the mid-line of the member 84 when the member is horizontally disposed. As such, when the flow of water into the member 84 is terminated, there is only the water between the upper half of the member 84 (as horizontally disposed and viewed in cross-section) and the outlet holes 88A, 88B that is available to flow out the holes, a relatively small amount of water that will be discharged relatively quickly. Moving the holes closer to the top of member 84 would provide even less water to be discharged following termination of the flow of water to the member and the water would be discharged over a lesser amount of time. Conversely, moving the holes closer to the bottom of the member 84 would provide more water to be discharged following the termination of the flow of water to the member and the water would be discharged over a greater amount of time. For a larger diameter member, the location of the holes has a greater significance on the amount of time needed to discharge the water following termination. For a smaller diameter member, the location of the holes has a lesser significance. It should be appreciated that the foregoing can be applied to an inner tubular member that has a different cross-section. It should also be appreciated that the relatively quick termination of the flow of water from the series of outlet holes 88A, 88B of the inner tubular member 84 coupled with the series of outlet holes 96 of the outer tubular member 82 being designed to cumulatively discharge at least as much water per unit time as the inner tubular member 84 is discharging through the series of outlet holes 88A, 88B results in a spray bar that ceases discharging water very soon after the flow on water into the spray bar is terminated, i.e., the spray bar 80 can be "turned off" relatively quickly.

It should be appreciated that when the flow of water to the inner tubular member 84 is commenced, the flow of water from the series of outlet holes 88A, 88B commences shortly thereafter. This, too, is a function of the dimensions of the member 84 and the location of the outlet holes 88A, 88B. When the flow of water into member 84 is commenced, water will begin to flow out of the outlet holes 88A, 88B when the water level has been raised from the current water level in the member to the level of the holes. Water will begin to flow from the outlet holes 88A, 88B at the desired rate when the member is entirely filled and under the desired pressure. In this case, moving the holes closer to the top of the member 84 would increase the time needed for the outlet holes 88A, 88B to start discharging water for a given inlet flow rate. Conversely, moving the outlet holes closer to the bottom of the member 84 would decrease the time needed to for the outlet holes to start discharging water for a given inlet flow rate. It should be appreciated that the relatively quick commencement of the flow of water from the series of outlet holes 88A, 88B of the inner tubular member 84 results in a spray bar that commences discharging water very soon after the flow of water into the spray bar is commenced, i.e., the spray bar 80 can be "turned on" relatively quickly.

Further, the series of outlet holes 96 are designed to discharge low-pressure streams of water that each breaks into a discontinuous stream of water droplets due to air resistance, rather than continuous streams or a continuous wall of water. These discharged droplets are discharged over a distance and form a relatively translucent wall of water that is presently considered adequate for use in producing a wall or portion of a wall of a maze. It should be appreciated that, because the wall of water droplets produced by the spray bar 80 is adequate for generating all or a portion of the wall of a maze, the amount of water needed to produce a maze is substantially less than that required to produce the same maze in a system that employs a piping system that discharges continuous streams or sheets of water. In the illustrated embodiment, the series of outlet holes 96 is comprised of three parallel lines of holes with each line have equally spaced holes and each line of holes being offset from the adjacent line of holes. In the illustrated embodiment, one line of holes is separated from the adjacent line of holes by about 0.25", the holes in a line are separated from one another by about 0.5", and each hole has a diameter of about 0.13". If a more translucent or less translucent wall of water droplets is desired, changes can be made to the number of lines of holes, spacing of holes, and/or size of the holes. Such changes may, however, require additional changes in the other elements of the spray bar and/or the rate at which water is received by the spray bar.

The spray bars in the array of spray bars 62 are located relative to one another so as to form a grid pattern of squares. Moreover, spray bars in the array 62 are connected to one another in a manner that: (a) facilitates the establishment of the grid pattern and (b) renders any gap between the end of one spray bar and the ends of the other spray bars to which the one spray is connected relatively small. Keeping this gap small and locating the series of outlet holes 96 of the spray bar such that any wall of water droplets produced using the spray bar extends substantially from one end of the tubular body 90 to the other end of the tubular body 90 renders any gap in the walls of water produced by sprays bars whose ends are connect to one another correspondingly small.

Figures 3A, 3B, 3C, 3D, 3E:
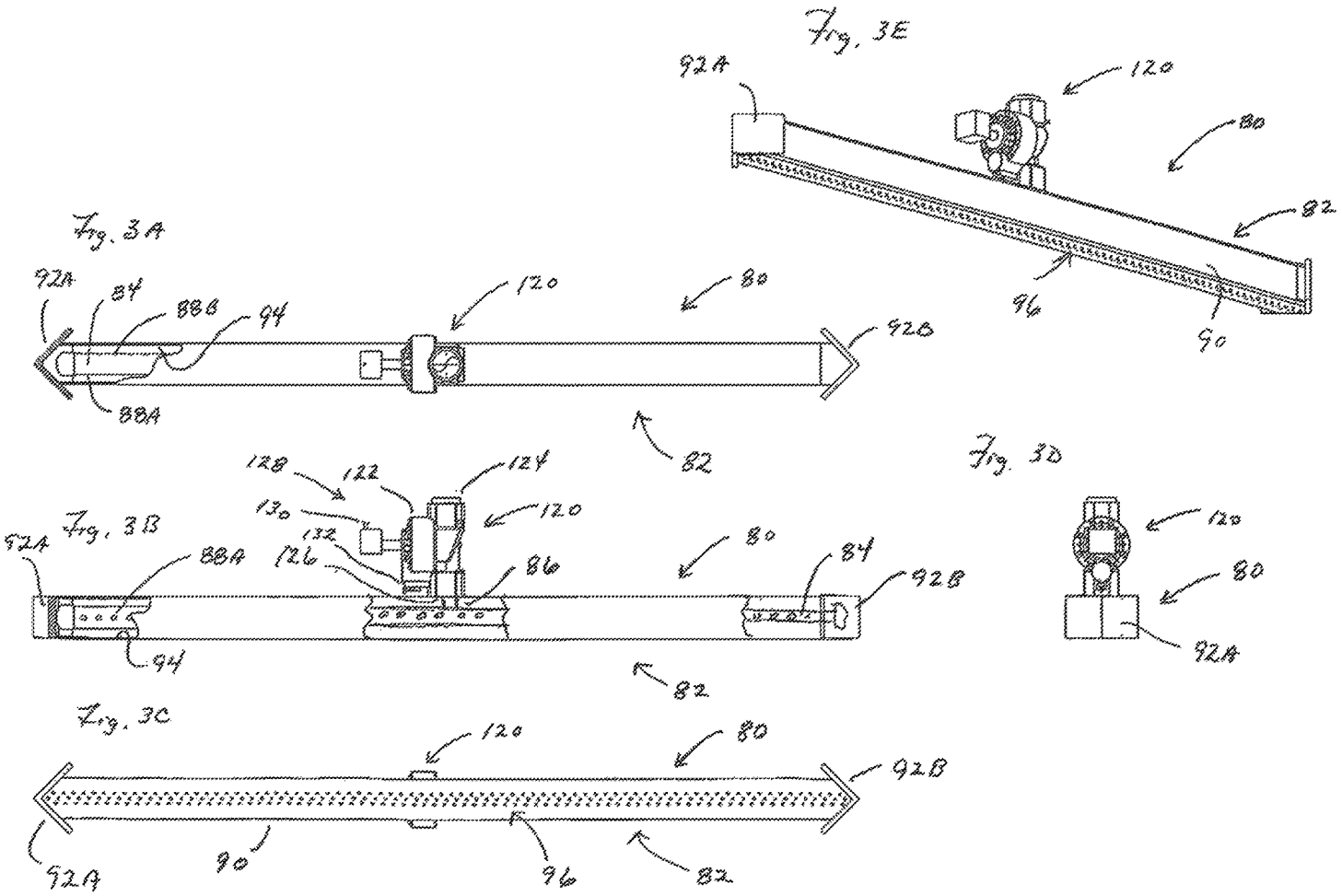
FIGS. 3A-3E illustrates an embodiment of a spray bar and an associated valve.

With reference to FIGS. 4A-4D, the system for connecting the ends of multiple sprays bars to one another is described. Generally, the system is comprised of the corner end cap of each of the spray bars that are to be connected to another and a bracket system that engages the end cap associated with the end of the spray bars that are to be connected to one another. As shown in FIG. 3A, the end cap 92A is comprised of a pair of planar members with an interior angle of 90° between the members, an exterior angle of 270° between the members, and a portion of each planar member extending past the lateral extent of the tubular body 90. The end cap associated with the end of each of the spray bars that are to be connected to one another is substantially identical to the end cap 92A. The bracket system 100 is comprised of a top member 102, a bottom member 104, four pairs of nuts and bolts 106A-106D that each engage the top member 102 and bottom member 104, and if needed, one or more "dummy" end caps that are not attached to a spray bar.

In operation, the top member 102 engages the top edges of four end caps, the bottom member 104 engages the bottom edges of the four end caps, and the four pairs of bolts 106A-106D connect the top member 102 to the bottom member 104. Further, located between each of the pairs of bolts 106A-106D is at least a portion of that portion of the planar member that extends beyond the lateral extent of the tubular body 90 (or, in the case of a dummy end cap, would extend beyond such a lateral extent if the dummy end cap was associated with a spray bar) for two end caps. As such, the bracket system 100 and end caps cooperate to establish a miter-type joint between the four end caps. Typically, at least two of these end caps are associated with two different spray bars that are to be connected to one another. If only two spray bars are to be connected, then two of the end caps are associated with the two spray bars that are to be connected to one another and the other two end caps are dummy end caps. FIG. 4C illustrates such a situation. Specifically, the bracket system 100 cooperates with end caps 112A-112D to establish a miter-type joint between the end caps and connect spray bar 114A to spray bar 114B. End caps 112A and 112B are respectively parts of spray bars 114A, 114B and end caps 112C and 112D are dummy end caps, neither of which is associated with a spray bar. Similarly, if only three bars are to be connected, then three of the end caps are associated with the three spray bars that are to be connected to one another and the fourth end cap is a dummy end cap. FIG. 4D illustrates such a situation.

It should be appreciated that the angle between the planar members of an end cap can be changed and the bracket system changed to engage the ends of a different number of spray bars. For instance, the exterior angle between the planar members of an end cap can be changed to 240° and the bracket system changed so as to engage the ends of three instead of four spray bars. This would facilitate the creation of an array of spray bars that has an equilateral triangle pattern instead of a grid pattern. Similarly, the exterior angle between the planar members of an end cap can be changed to 300° and the bracket system changed so as engage the ends of six spray bars.

With reference to FIG. 4E, an overhead connector surface 118 is attached to the top member 102 of the bracket system 100 and facilitates the connection of the bracket system and any attached spray bars to the overhead support 64. In the illustrated embodiment, the connector surface 118 defines a hole that is suitable for engaging a hook or similar structure associated with whatever device or devices are used to engage the overhead support. Other types of overhead connecting surfaces are feasible. For instance, a surface that defines a hole for engaging a rod of all thread is feasible. An overhead connector surface can be placed elsewhere. For instance, an overhead connector surface can be attached to the outer tubular member 82 of the spray bar 80 and preferably done in a manner that does not interfere with the wall of water droplets produced when the spray bar is activated.

The array of valves 68 is used to control the application of water provided by the water source 66 to the array of spray bars 62. In the illustrated embodiment, each valve in the array of valves 68 is associated with only one spray bar in the array of spray bars 62. In some instances, a long spray bar may require two or more valves of the array of valves 68 with each valve operatively connected to a long inner tubular member or with each valve connected to one of a number of shorter inner tubular members in order to distribute the water adequately within the outer tubular member. Nonetheless, each of the valves of the array of valves 68 is associated with only one spray bar. With reference to FIGS. 3A-3E, a valve 120 that is associated with the spray bar 80 is described. The valve 120 has a body 122 that defines an inlet port 124 for receiving water provided by the water source 66 and an outlet port 126 for providing water to the inlet 86 of the inner tubular member 84 of the spray bar 80. The valve 120 also has an air pilot valve 128 that is used to place the valve 120 in a first state in which water is allowed to pass through the outlet port 126 to the inner tubular member 84 or in a second state in which water is prevented from passing through the outlet port 126 to the inner tubular member 84. The air pilot valve 128 has a pneumatic input 130 for engaging a pneumatic line that provides a flow of air and an electrical input 132 that controls whether the air received at the pneumatic input 130 is allowed to pass through and place the valve in the first state or prevented from passing through and place the valve in the second state. The electrical input 132 receives an electrical signal that is low voltage and low amperage due to the proximity of the valve 120 to water and to individuals that may come into contact with the water. In the illustrated embodiment, the valve 120 is a model 57100 valve manufactured by Orbit.

Figure 5:
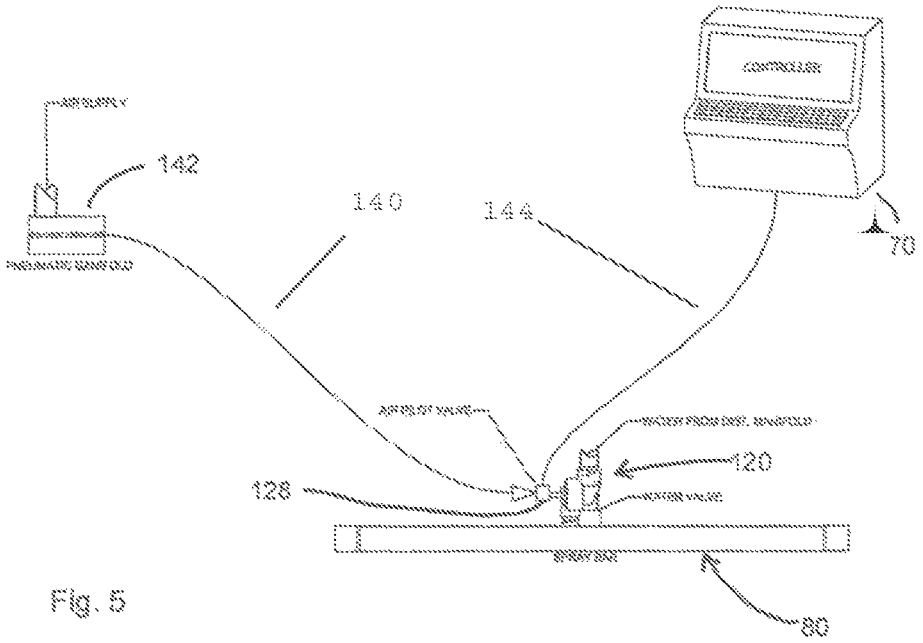
FIG. 5 illustrates the structure for controlling whether a valve in the array of valves is in a first state in which the valve provides water to a spray bar or in a second state in which valve prevents water from being provided to the spray bar.
Figure 6:
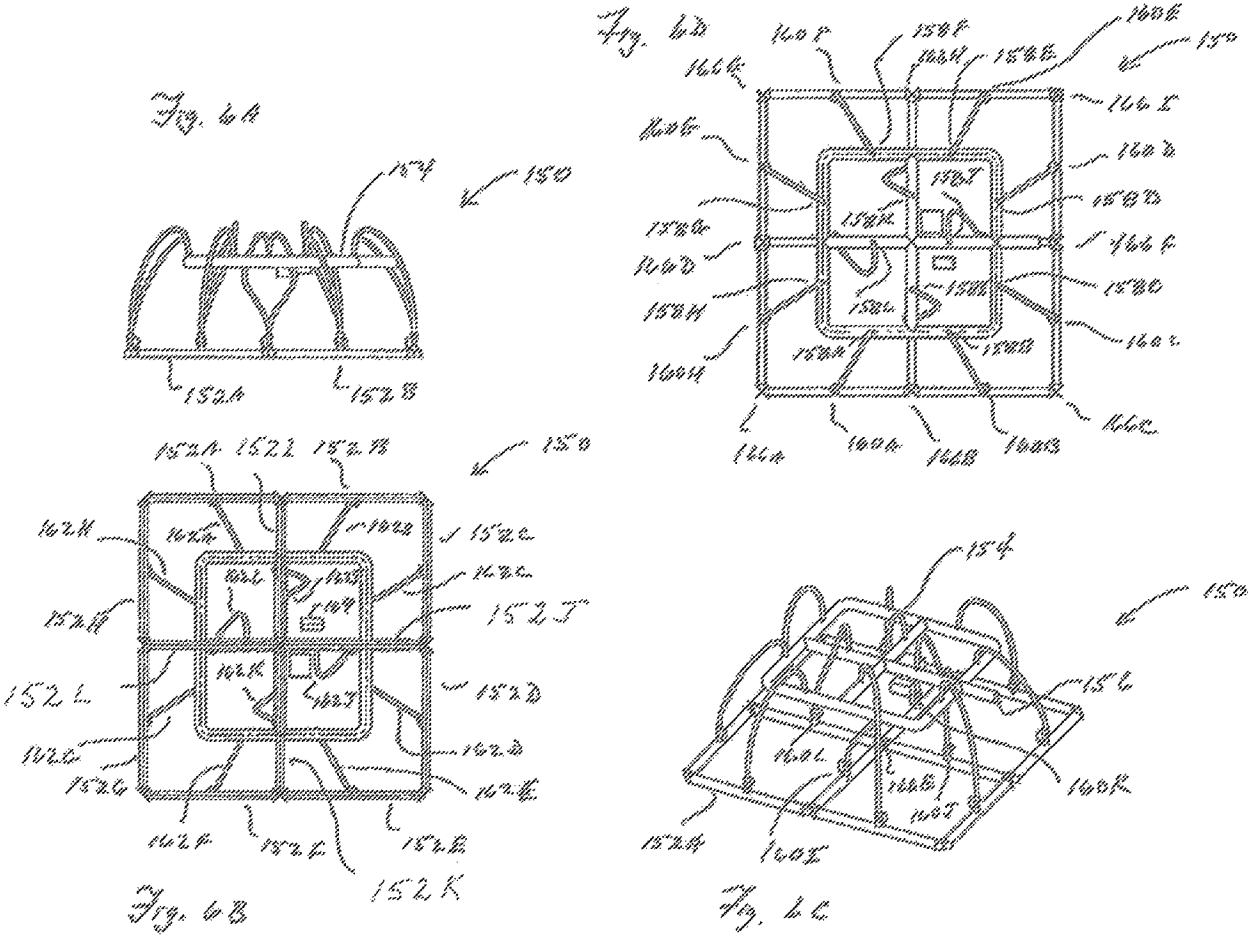
FIGS. 6A-6D illustrate a module comprised of a group of spray bars, a sub-water manifold, and a group of valves for controlling the application of water from the sub-water manifold to the group of spray bars.

With reference to FIG. 5, the operation of the valve 120 is described. A pneumatic line 140 provides air to the pneumatic input 130 of the valve. Typically, the pneumatic line 140 originates at a pneumatic manifold 142 that receives air from an air source and distributes the received air to a plurality of outlet ports that each engages a pneumatic line that runs to the pilot valve 128 associated with a valve 120. The controller 70 provides an electrical signal via an electrical line 144 to the electrical input 132 of the air pilot valve 128 that determines whether the air provided by the pneumatic line 140 is allowed to pass through the pilot valve 128 and place the valve in the first state or the air provided by the pneumatic line is prevented from passing through the valve and any air that has previously passed through is vented to the atmosphere so as to place the valve in the second state. Other types of valves are feasible. For example, valves that are entirely pneumatic can be employed. However, such valves typically have a substantially slower response time. Hydraulic valves can also be employed.

In the illustrated embodiment, there is a valve 120 associated with each spray bar in the array of spray bars 62, which collectively is the array of valves 68. Further, the controller 70 is capable of providing an electrical signal to each such valve via an electrical line that runs to the electrical input of the valve. Consequently, the controller 70 defines whether the valve 120 associated with each spray bar in the array of spray bars 62 is in the first state or the second state and, hence, whether the spray bar is producing a wall of falling water droplets that define a wall or a portion of a wall of a maze or not producing a wall of falling water droplets.

In particular applications, locating all or part of the array of valves 68 a significant distance from the array of spray bars 62 may be feasible. With respect to any valves that are located at a significant distance from the array of spray bars 62, the concerns of the proximity of electricity to water and individuals that may come into contact with the water may abate and allow for the use of electrically driven valves that would not be appropriate if located as in the illustrated embodiment.

In other applications, the use of manual valves that eliminate the need for the controller 70 to define the state of any such valves may be appropriate. Any such manual valves could be attached to the spray bar, as the valve 120 is attached to the spray bar 80, or located a significant distance from the array of spray bars 62. Further, a group of manual valves that are located a significant distance from the array of spray bars 62 could be arranged in a manual valve manifold. Regardless of whether any such manual valves are attached to spray bars or located distally from the array of spray bars, the use of manual valves is likely to adversely affect the speed with which the state of valves can be altered and the configuration of a maze changed.

Locating a valve a significant distance from the spray bar with which the valve is associated may, in certain situations, also reduces the speed with which the spray bar transitions from providing a wall of water droplets to not providing a wall of water droplet (i.e., transitions from an active to inactive state). To elaborate, when a valve is located a significant distance from the spray bar with which the valve is associated, there will need to be a water line that extends from the valve to the spray bar. If the water in this line drains into the spray bar after the valve is closed, the time needed for the spray bar to transition from an active to inactive state will increase. Similarly, if the water drains from the line when the spray bar transitions from an active to inactive state, the line will need to be recharged when the spray bar transitions from the inactive state to the active state. This recharging will increase the time needed to transition the spray bar from an inactive to active state.

The drained floor 72 preferably presents an outer or upper surface suitable for individuals to walk or run over while not presenting significant discontinuities that could cause an individual to fall or trip and providing adequate drainage of the water output by the array of spray bars 62 when the apparatus is in operation. An example of such a floor is a floor that has pavers with small open seams between the pavers that allow water to drain away from the tops of the pavers. The water collected by the floor 72 can, depending on the situation, be returned to the water source 66 or discarded. In certain situations, it may be possible to forego the drained floor 72. For example, if the array of spray bars 62 is suspended over a beach or other natural surface that has adequate drainage, the drained floor 72 may be unnecessary. Further, if the array of spray bars 62 is located over a shallow pool, there is no need for the drained floor. In this case, the water produced by the array of spray bars 62 falls into the pool and is processed by whatever water circulation and/or filtration system is associated with the pool.

The assembly of the array of spray bars 62 and the suspending of the array from the overhead support 64 is or can be facilitated by using modules that each includes a number of spray bars connected to one another. With reference to FIGS. 6A-6D, an embodiment of a module 150 is described. The module 150 is comprised of twelve spray bars 152A-152L, a sub-water manifold 154 with an inlet port 156 for receiving water and twelve outlet ports 158A-158L, twelve valves 160A-160L with each valve associated with one of the twelve spray bars 152A-152L and each valve used to control the application of water from the sub-water manifold 154 to the spray bar with which the valve is associated, twelve water lines 162A-162L with each line extending from one of the outlet ports 158A-158L of the sub-water manifold 154 to one of the valves 160A-160L, a pneumatic manifold 164 with an inlet (not shown) for receiving air and twelve outlets (not shown) that are each associated with a pneumatic line that engages the pilot valve 128 associated with one of the valves 160A-160L, and nine spray bar connectors 166A-166I that each connect an end of at least two and no more than four of the spray bars 152A-152L to one another. The overhead connecting surface 118 that is associated with each of the spray bar connectors 166A-166I is available for use in suspending the module 150 from the overhead support. Typically, the sub-water manifold 154 is also suspended from the overhead support by a separate mechanism.

The module 150 is a fully populated module because the module 150 has twelve spray bars, the maximum number of spray bars for a 2×2 grid-type module. Underpopulated 2×2 modules, (i.e., a modules with as few as four spray bars and no more than eleven spray bars (i.e., an under-populated module) are built to take into account the other module or modules to which the under-populated module is to be joined. For example, an under-populated module that has four spray bars corresponding to the 152I-152L spray bars of the module 150 can be built with a view to connecting the module to four other modules with one of these four modules providing what would be spray bars 152A, 152B in the module 150, a second of these four modules providing what would be spray bars 152C, 152D in the module 150, a third of these four modules providing what would be spray bars 152E, 152F in the module 150, and the fourth of the four modules providing what would be spray bars 152G, 152H in the module 150. The sub-water manifold employed with an under-populated module is the sub-water manifold 154 with the unused outlet ports plugged.

Figure 7:
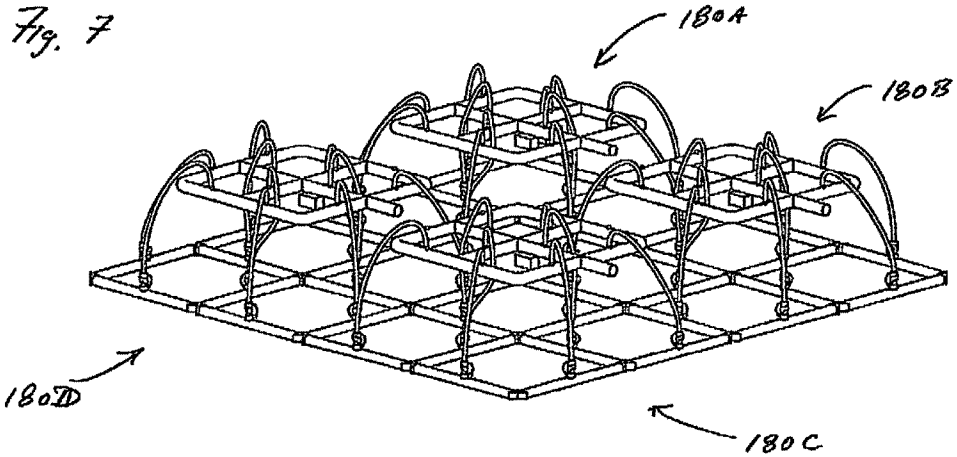
FIG. 7 illustrates four modules joined together to form a larger array of spray bars than is provided by any one of the modules.
Figure 8:
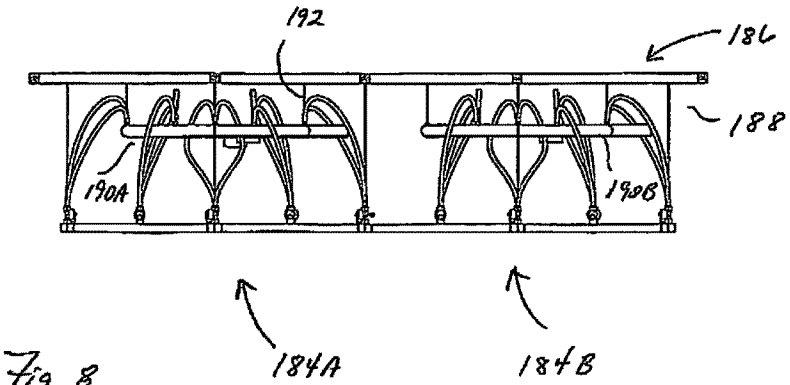
FIG. 8 illustrates two modules suspended from an overhead support.

An example of the joining of a fully populated module with other under-populated modules is illustrated in FIG. 7. In FIG. 7, four 2×2 modules 180A-180D are joined together to form a large array of spray bars. The module 180A is the only fully populated module, as can be seen by a water line extending from each of the twelve outlet ports of the sub-water manifold. The sub-water manifold associated with each of the other modules 180B-180D has at least two unused/plugged outlet ports, indicating that module was assembled as an under-populated module. FIG. 8 illustrates two modules 184A, 184B each suspended from and overhead support 186. The modules 184A, 184B are suspended from the overhead support 186 using all-thread rods 188 that extend between the overhead support 186 and several of the spray bar connectors associated with the two modules. The use of all-thread rods allows the distance from each of the spray bar connectors to the overhead support 186 or to the underlying surface to be adjusted. In this regard, the all-thread rods can be used to level a module or to place a module out of level. Placing a module out of level will cause any spray bars that are activated in the module to output a wall of falling water droplets that, when the wall is first being created, "wipes" across the spray bar, i.e., the streams of water discharged from the spray bar do not start substantially at the same time as with a level spray bar but commence at one of the spray bar and progress towards the other end of the spray bar. In addition, the sub-water manifolds 190A, 190B are also suspended from the overhead support 186 by one or more connector 192. It should be appreciated that the system for supplying water to the spray bars associated with the two modules 184A, 184B is located above the spray bars. As such, the use of upright structures to provide water to the modules 184A, 184B within the shadow of the spray bars is avoided.

A module can be smaller or larger than the 2×2 module 150. The smallest module is comprised of two spray bars connected to one another. However, the smallest module likely to be used in practice is comprised of four spray bars that are connected to one another so as to form a square. A larger module could be a 2×3 module. However, larger modules that are likely to be most used in practice are n×n modules, e.g. 3×3 and 4×4 modules. For modules that are used to produce regular polygons of different shapes (e.g., an equilateral triangle or pentagon), the smallest module likely to be used in practice is comprised of the minimum number of spray bars needed to form a single regular polygon (e.g., a single equilateral triangle or a single pentagon). Larger modules, in this case, comprise two or more of these regular polygons.

Figure 9:
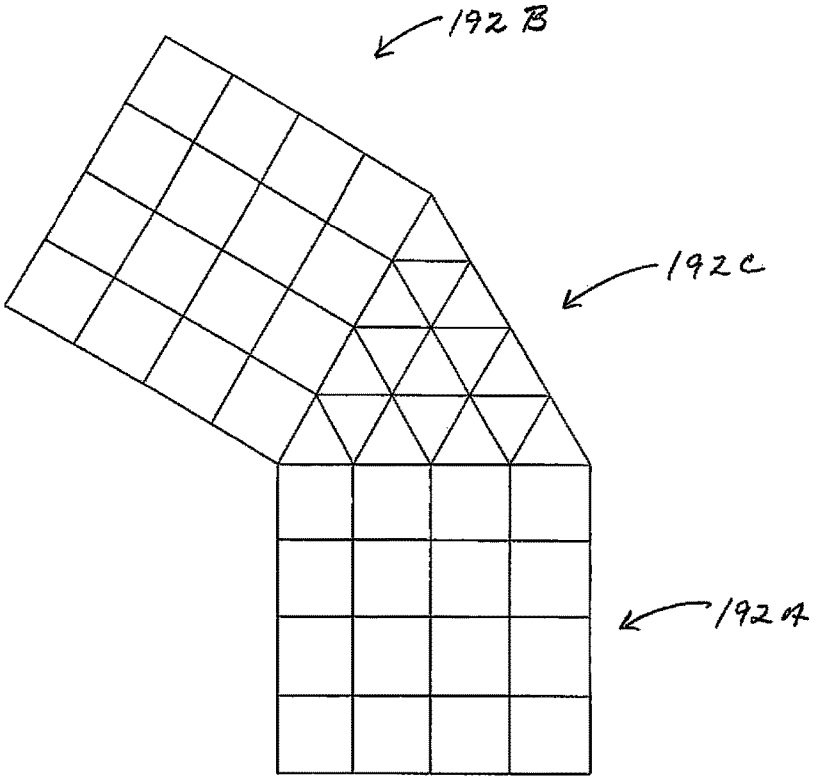
FIG. 9 illustrates a spray bar array comprised of two "square" modules and one equilateral module.

FIG. 9 illustrates the use of a first 4×4 module 192A, second 4×4 module 192B, and an equilateral triangle module 192C to realize a spray bar array that has an overall shape that is neither a square nor an equilateral triangle. As such, it should be appreciated that modules with different shapes can be used to produce spray bars arrays of varied overall shapes. This, in turn, allows an array of spray bars to be constructed that can fit within areas having unusual or constrained shapes.

It should be appreciated that modules can be constructed without a sub-water manifold. For such a module, a separate water line must be run from the water source to each of the spray bars in the module when the module is integrated into the array of spray bars. For large arrays of spray bars comprised of multiple modules, the running of a separate line from the water source to each spray bar typically becomes quite cumbersome. In such cases, the use of a sub-water manifold with each or a substantial number of the modules being used to construct the array of spray bars typically is significantly less cumbersome.

Further, a module can be constructed without a sub-water manifold and without one or more valves attached to each of the spray bars in the module. This may be appropriate when all or a portion of the array of valves 68 is going to be located a significant distance from the array of spray bars. For such a module, a separate water line must be run from the valve or valves that are associated with a particular spray bar to the particular spray bar for each of the spray bars in the module. The running of separate water lines to each spray bar in a module typically becomes increasingly cumbersome as the array of spray bars becomes larger and larger. The incorporation of a sub-water manifold and valves into a module typically renders the construction of the array of spray bars less cumbersome.

A module can also be constructed without a pneumatic manifold and a separate air line can be run from the source of compressed air to each valve in the module. This can also become quite cumbersome, particularly for large arrays of spray bars. The use of a pneumatic manifold with each or a substantial number of the modules typically is much less cumbersome.

The components needed to construct an array of spray bars in which multiple spray bars are joined to one another and an array of valves for controlling the flow of water to the array of spray bars can be provided in a kit form. In one embodiment, the kit includes a plurality of substantially identical spray bars that are not connected to one another, a plurality of substantially identical spray bar connectors for connecting spray bars to one another, and a plurality of substantially identical valves with each valve capable of being associated with only one spray bar. In another embodiment, the kit includes multiple modules with each module being a combination of spray bars, spray bar connectors, and valves. For example, in one embodiment, the kit includes a number of modules with each module having a plurality of spray bars connected to one another by spray bar connectors. This embodiment of the kit also includes a plurality of valves that are substantially identical to one another. In another embodiment, the kit includes a number of modules with each module having a spray bar and one or more valves attached to each spray bar. This embodiment of the kit also includes a plurality of spray bar connectors.

Figure 10:
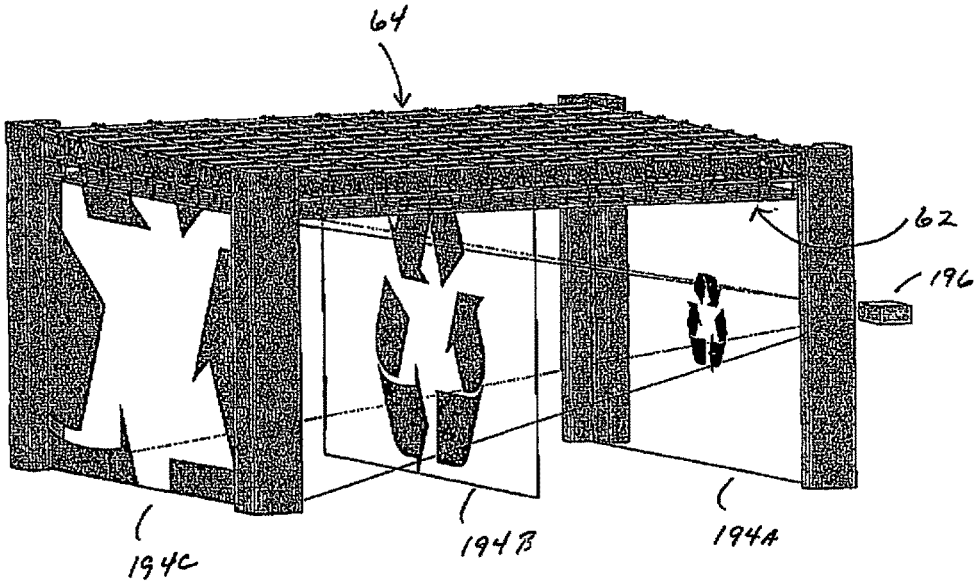
FIG. 10 illustrates the use of the apparatus capable of producing a reconfigurable maze to produce a light show.
Figure 11A:
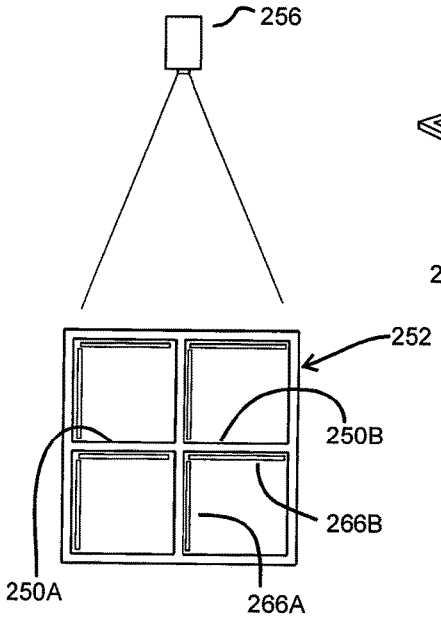
FIGS. 11A-11B respectively are a plan view and a perspective view of a single screen of falling water droplets and a projector for projecting an image on the screen.
Figure 11B:
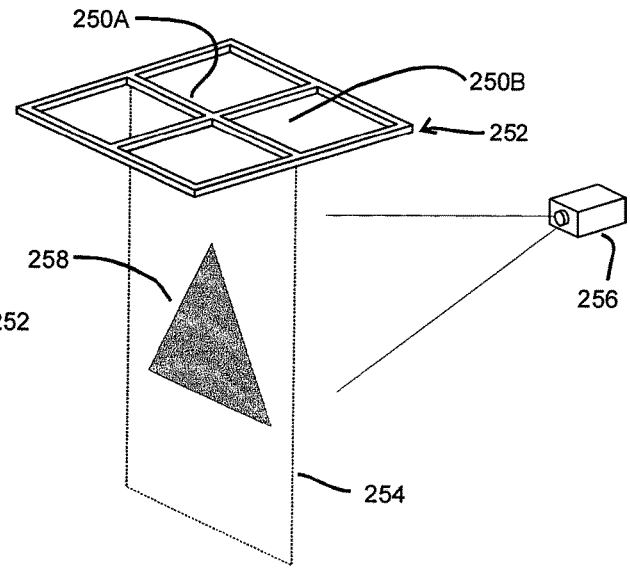
Figure 12A:
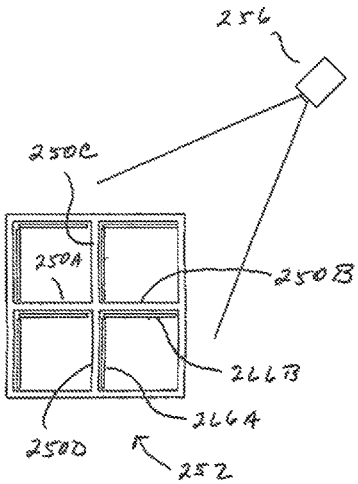
FIGS. 12A-12B respectively are a plan view and a perspective view that illustrates the use of the apparatus to produce a volumetric image.
Figure 12B:
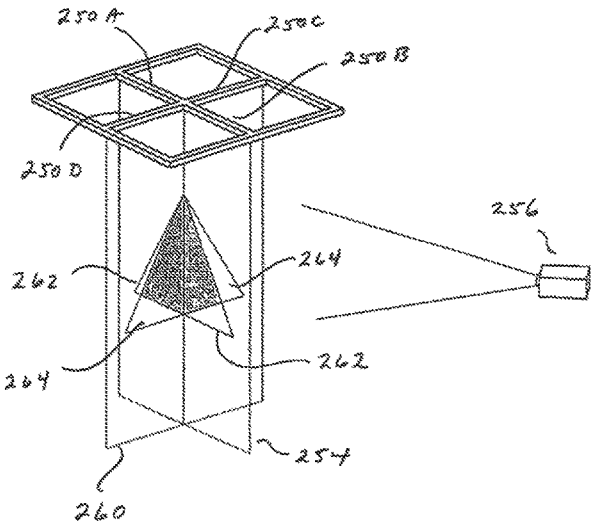

The ability of the apparatus 60 to produce numerous and/or changing walls of falling water droplets that can be used to create translucent projection screens allows the apparatus to be used to create light/display shows with interesting visual effects. With reference to FIG. 10, an example of the use of the apparatus 60 to produce a light show is described. In FIG. 10, the array of valves has been used to activate the spray bars in the array of spray bars 62 needed to produce three translucent screens 194A-194C and to deactivate all of the other spray bars in the array of spray bars 62. A projector 196 is used to project an image on the translucent screens 194A-194C. Preferably, the projector 196 is a digital-light-projector (DLP) that can project a focused image over a considerable range without requiring adjustment. Other types of projectors can be utilized. However, a projector that is more constrained as to the range over which a focused image can be produced may, to the extent focused images are needed or desired, constrain the locations of the screens upon which light or an image can be projected at a particular point in time. Changing screens may require adjustment of the focus. If the projector allows for computer controlled focusing, this refocusing can be done by the controller 70 in coordination with the changing of the screens. Due to the difference in distances between the projector 196 and the three screens 194A-194C, the image is of a different size on each of the screens. As can be appreciated, the array of valves 68 can also be used to sequence the screens 194A-194C such that the projected image appears to move. More specifically, the array of valves can be used to "turn on" the screen 194A and "turn off" screens 194B-194C, thereby resulting in the image being projected only on screen 194A. Subsequently, the array of valves 68 can be used to turn off screen 194A, turn on screen 194C, and keep screen 194B turned off. The image would then appear to have jumped from screen 194A to screen 194C and increased in size. Subsequently, the array of valves can be used to turn off screen 194C, turn on screen 194B, and keep screen 194A turned off. The image would then appear to have jumped from screen 194C to screen 194B and decreased in size. Numerous other variations involving the use of the array of valves 68 to turn on and turn off translucent water screens are feasible. For example, the array of valves 68 can be used to turn on or turn off a screen in a manner that is coordinated with the image being produced by the projector. For instance, the array of valves 68 could be used to establish only screen 194B to receive a first image being projected by the projector. Subsequently, the array of valves could be used to turn off screen 194B and turn on screen 194C to receive a second image that is different than the first image. The use of multiple projectors and the coordination of the images produced by the projectors with the turning on and turning off of screens by the array of valves 68 is also feasible. Typically, the controller 70 would be programmed to coordinate the operation of the array of valves 68 in turning on and turning off screens with the image or images being projected by the projector or projectors. With reference to FIGS. 11A-11B and 12A-12B, the apparatus 60 can also be used with a projector to produce "volumetric" images. To elaborate, FIGS. 11A-11B illustrate the use of two spray bars 250A, 250B in a 2×2 array of spray bars 252 to produce a planar screen 254. A projector 256 is used to project a triangle image 258 on the screen 254. FIGS. 12A-12B illustrate the use of the spray bars 250A, 250B to produce the planar screen 254 and the use of the spray bars 250C, 250D to produce a second planar screen 260 that is substantially perpendicular to the screen 254. Further, the projector 256 is positioned so as to, in effect, project a first triangle image 262 on to the screen 254 and a second triangle image 264 on to the second screen 260. Due to the screens intersecting one another, the image seen by a spectator has a volumetric characteristic, i.e., the image is volumetric and can perhaps be characterized as three-dimensional. It should be appreciated that this effect is not constrained to screens that are perpendicular to one another. Consequently, arrays of spray bars that are laid out in other than a grid-like pattern can also be used to practice this effect. Additionally, more than two screens can be used to further enhance this effect if the array of spray is capable of being used to create three or more intersecting screens or multiple screens associated with multiple modules.

With references to FIGS. 11A and 12A, a pair of down directed lighting strips 266A, 266B is associated with two of the four spray bars that make up a single square of spray bars in the 2×2 array of spray bars 252. Each of the lighting strips 266A, 266B can be turned "on" or "off" by the controller 70. When a lighting strip is in the "on" state, whatever color of light is being output by the light is directed so as to engage any wall of falling water droplets that is being produced by the spray bar with which the light strip is associated. The lighting strips are low voltage and low current lighting strips. In the illustrated embodiment, the lighting strips are LED lighting strips manufactured by Traxon. Each of the lighting strips can be of a type that outputs a single color of light or of a type that can selectively output different colors of light. Two light strips are associated with each square of the 2×2 array of spray bars 252. As such, four of the exterior spray bars of the array 252 are not associated with a lighting strip. Each of these four exterior spray bars will, however, be associated with a light strip when the array is connected to two, similar 2×2 arrays. Certainly, if the array 252 was located at the edge of the overall array of spray bars and light strips were not associated with one or more of the exterior spray bars of the array 252, light strips could be associated with any such exterior spray bars.

Figure 15:
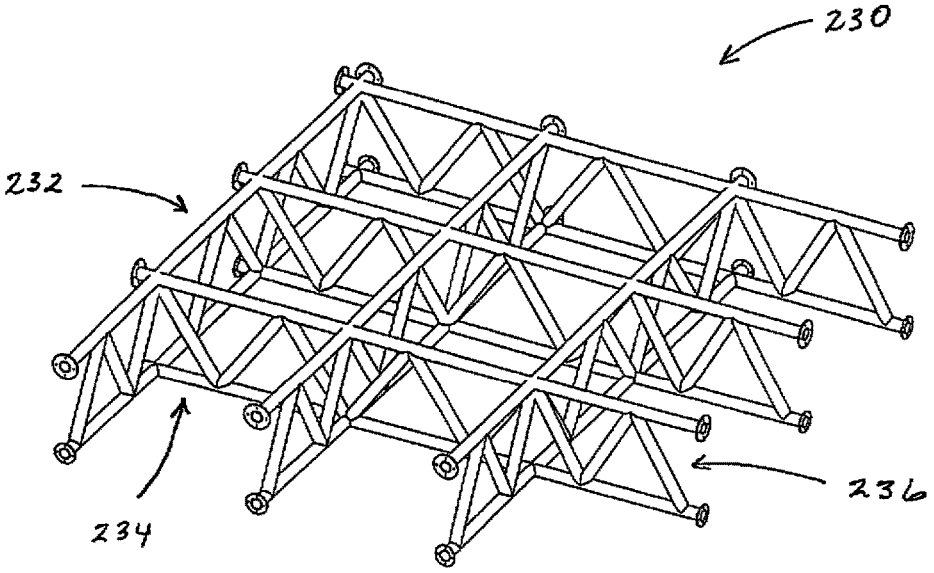
FIG. 15 illustrates a modular structure that can be utilized to realize at least a portion of an overhead support, at least a portion of a water manifold for distributing water to spray bars, and at least a portion of a manifold for distributing air to valves.

With continuing reference to FIG. 10, the overhead support 64 has been adapted so as to serve as a surface from which the array of spray bars 62 can be suspended and to also serve as a water manifold for distributing water to the spray bars and a pneumatic manifold for distributing air to the valves. As such, the overhead support 64 avoids the need for one or more pneumatic manifolds 142 and one or more sub-water manifolds 154. With reference to FIGS. 13A-13C, the overhead support 64 can be realized using combinations of one or more of each of a first component 210A, a second component 210B, and a third component 210C. Characteristic of each of the components 210A-210C respectively is an upper pipe structure 212A-212C for carrying air, a lower pipe structure 214A-214C for carrying water, and a truss or connector 216A-216C for connecting the upper pipe structure to the lower pipe structure. Eight flanges are associated with each of the components, four with the upper pipe structure and four with the lower pipe structure. The flanges facilitate the connection of components to one another to realize the overhead structure and the distribution manifolds. One or more of the flanges associated with the upper pipe structures of the support 64 is/are connected to a source of compressed air. Similarly, one of more of the flanges associated with the lower pipe structures of the support 64 is/are connected to a source of water. Typically, several of the flanges associated with each of the resulting upper and lower pipe structures of the support 64 are connected to a cap that seals the end of the relevant pipe. The longer portions of the upper and lower pipe structures of the components 210A, 210B have ports that respectively allow air and water to be distributed to the valves and spray bars. Each of the components 210A-210C also respectively includes a connector surface 218A-218C for engaging a connecting device that also engages the overhead connector surface 118 of one of the bracket systems 100. FIG. 14 illustrates a pair of spray bars 220A, 220B that are connected to one another by one of the bracket systems 100 suspended from the first component 210A by a connector 222 that engages the overhead connector surface 118 of the bracket system and the connector surface 218A of the first component 210A. With reference to FIG. 15, the overhead support 64 can also be realized by a structure 230 that has an upper pipe array 232 for carrying air, a lower pipe array 234 for carrying water, and truss structure 236 connecting the upper pipe array 232 and the lower pipe array 234. The structure 230 respectively provides a 2×2 array of spray bars and associated valves with water and air. A comparable structure comprised of the components 210A-210C that require numerous connections to be made between the components. Consequently, the structure 230 generally speeds the construction of the apparatus. Nonetheless, if needed, the structure 230 can be connected to any of the components 210A-210C if needed.

The foregoing description of the invention is intended to explain the best mode known of practicing the invention and to enable others skilled in the art to utilize the invention in various embodiments and with the various modifications required by their particular applications or uses of the invention.

What is claimed is:

1. An apparatus for use in producing a wall of falling water droplets, the apparatus comprising:

a tubular structure that extends from a first end to a second end, includes an input port for receiving water, and a plurality of output ports through which water received at the input port is dispersed to form a wall of falling water droplets; and a first angular member associated with the first end of the tubular structure to facilitate miter-style positioning with another similar apparatus.

2. An apparatus, as claimed in claim 1, wherein:

the first angular member includes two planar surfaces with an angle between the two planar surfaces being other than 180 degrees.

3. An apparatus, as claimed in claim 1, wherein:

the first angular member extends across and closes the first end of the tubular structure.

4. An apparatus, as claimed in claim 1, further comprising:

a second angular member that is associated with the second end of the tubular structure.

5. An apparatus, as claimed in claim 4, wherein:

the second angular member includes two planar surfaces with an angle between the two planar surfaces being other than 180 degrees.

6. An apparatus, as claimed in claim 5, wherein:

the second angular member extends across and closes the second end of the tubular structure.

7. An apparatus, as claimed in claim 1, wherein:

the tubular structure includes:

an inner tubular member for receiving a stream of water and outputting a plurality of lesser streams of water through a series of holes located along the length of the inner tubular member; and an outer tubular member for receiving the plurality of lesser streams of water, causing the lesser streams of water to each spread along the longitudinal extent of the outer tubular member, and allowing the spread water to drain through the plurality of output ports located along the length of the outer tubular member.

8. An apparatus for use in producing a wall of falling water droplets, the apparatus comprising:

a tubular structure that extends from a first end to a second end, includes an input port for receiving water, and a plurality of output ports through which water received at the input port is dispersed to form a wall of falling water droplets;

a first angular member associated with the first end of the tubular structure to facilitate miter-style positioning with another similar apparatus; and a second angular member that is associated with the second end of the tubular structure to facilitate miter-style position with another similar apparatus.

9. An apparatus, as claimed in claim 8, wherein:

the first angular member includes a first pair of planar surfaces with an angle between the planar surfaces being other than 180 degrees; and the second angular member includes a second pair of planar surfaces with an angle between the planar surfaces being other than 180 degrees.

10. An apparatus, as claimed in claim 9, wherein:

the angle between the first pair of planar surfaces is 360 divided by an integer greater than 2;

the angle between the second pair of planar surface is 360 divided by an integer greater than 2.

11. An apparatus, as claimed in claim 10, wherein:

The angle between the first pair of planar surfaces is substantially equal to the angle between the second pair of planar surfaces.

* * * * *